US009988225B1

(12) United States Patent
Ikegami

(10) Patent No.: US 9,988,225 B1
(45) Date of Patent: Jun. 5, 2018

(54) SHEET CONVEYER AND IMAGE FORMING APPARATUS

(71) Applicant: Brother Kogyo Kabushiki Kaisha, Nagoya-shi, Aichi-ken (JP)

(72) Inventor: Yusuke Ikegami, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days. days.

(21) Appl. No.: 15/816,330

(22) Filed: Nov. 17, 2017

(30) Foreign Application Priority Data

Nov. 24, 2016 (JP) ..... 2016-228168

(51) Int. Cl.
*B65H 3/06* (2006.01)
*G03G 15/00* (2006.01)

(52) U.S. Cl.
CPC ..... *B65H 3/0684* (2013.01); *G03G 15/6511* (2013.01); *B65H 2402/542* (2013.01); *B65H 2403/512* (2013.01); *B65H 2515/34* (2013.01); *B65H 2601/523* (2013.01); *B65H 2801/03* (2013.01)

(58) Field of Classification Search
CPC .. B65H 3/0684; B65H 3/06; B65H 2402/542; B65H 2403/51; B65H 2515/34; B65H 2403/512; G03G 15/6511
See application file for complete search history.

(56) References Cited

U.S. PATENT DOCUMENTS 5,145,163 A * 9/1992 Cowan ..... B65H 3/0684 221/197
5,501,444 A * 3/1996 Yukimachi ..... B65H 1/14 271/10.11
5,893,555 A * 4/1999 Kawada ..... B65H 1/14 271/117
5,927,703 A * 7/1999 Endo ..... B65H 3/06 271/10.03
6,425,578 B1 * 7/2002 Wood ..... B65H 3/0684 271/110
7,515,867 B2 * 4/2009 Yano ..... G03G 15/6511 399/388
7,681,877 B2 * 3/2010 Won ..... G03G 15/5004 271/117
8,118,299 B2 * 2/2012 Sato ..... B65H 3/0684 271/117

(Continued)

FOREIGN PATENT DOCUMENTS

JP H11-171354 A 6/1999

*Primary Examiner* — Jeremy R Severson
(74) *Attorney, Agent, or Firm* — Banner & Witcoff, Ltd.

(57) ABSTRACT

A sheet conveyer having a load applier unit is provided. The load applier unit includes a contacting member, a lever, a contractive spring, and a preloading member. The lever is movable between a first position, in which the lever being moved in a direction to stretch the contractive spring causes the contractive spring having been stretched by the preloading member to be further stretched to urge the contacting member and causes the load applier unit to apply a load that acts in a direction to press a feed roller against sheets on a tray to the holder, and a second position, in which the contractive spring is maintained in a condition stretched by the preloading member without causing the load applier unit to apply the load that acts in the direction to press the feed roller against the sheets on the tray to the holder.

8 Claims, 8 Drawing Sheets

(56) References Cited

U.S. PATENT DOCUMENTS

| | | | | |
|---|---|---|---|---|
| 8,123,211 | B2 * | 2/2012 | Akiyama | B65H 3/0669 271/117 |
| 8,328,182 | B2 * | 12/2012 | Lino | B65H 3/0684 271/117 |
| 8,465,017 | B1 * | 6/2013 | Hayakawa | B65H 3/0669 271/117 |
| 9,022,382 | B2 * | 5/2015 | Takai | B65H 3/0684 271/125 |
| 2016/0347560 | A1 * | 12/2016 | Murata | B65H 3/0669 |

* cited by examiner

SHEET CONVEYER AND IMAGE FORMING APPARATUS

CROSS REFERENCE TO RELATED APPLICATION

This application claims priority from Japanese Patent Application No. 2016-228168, filed on Nov. 24, 2016, the entire subject matter of which is incorporated herein by reference.

BACKGROUND

Technical Field

An aspect of the present disclosure is related to a sheet conveyer having a feed roller and to an image forming apparatus having the sheet conveyer.

Related Art

A sheet conveyer, having a feed roller to feed sheets supported on a tray and a separator roller to separate the fed sheets from one another, is known. The feed roller may be urged against the sheets while a holder to hold the feed roller and the separator roller is pulled in one direction by a spring hooked to the holder so that a specific intensity of pressure to convey the sheets may be applied to the sheets through the feed roller.

SUMMARY

In a sheet conveyer configured as above, in order to apply the specific intensity of the pressure required to convey the sheets to the sheets, a substantial amount of stroke may be reserved to pull the spring. Therefore, it may be necessary to reserve a larger room for the stroke, and a volume of the sheet conveyer may tend to be increased.

The present disclosure is advantageous in that a sheet conveyer, which may be downsized effectively, wherein a feed roller may be pressed against a sheet to feed the sheet, and an image forming apparatus having the sheet conveyer are provided.

According to an aspect of the present disclosure, a sheet conveyer, having a tray, a feed roller, a separator roller, a holder, an arm, a load applier unit, and a cam member, is provided. The tray is configured to support a plurality of sheets. The feed roller is configured to contact one of the plurality of sheets and rotate to convey the one of the plurality of sheets in a conveying direction. The separator roller is arranged downstream from the feed roller along the conveying direction and is configured to separate the one of the plurality of sheets conveyed by the feed roller from the other of the plurality of sheets. The holder is supported swingably to swing about a rotation shaft of the separator roller and supports the feed roller rotatably. The arm extends along an axial direction of the rotation shaft of the separator roller and is engaged with the holder and configured to swing the holder. The load applier unit is configured to apply a load to the holder through the arm. The load applier unit includes a contacting member engaged with the arm, a lever movable in a vertical direction, a contractive spring engaged with the contacting member and the lever to contract in a contracting direction to pull the contacting member and the lever to be closer to each other, and a preloading member interposed between the contacting member and the lever and is configured to maintain the contractive spring in a condition stretched to be longer than a natural length. The cam member is configured to be driven by a driving source to move the lever in the vertical direction. The lever is movable by the cam member being driven between a first position, in which the lever being moved in a direction to stretch the contractive spring causes the contractive spring having been stretched by the preloading member to be further stretched to urge the contacting member and causes the load applier unit to apply a load that acts in a direction to press the feed roller against the plurality of sheets to the holder, and a second position, in which the contractive spring is maintained in a condition stretched by the preloading member without causing the load applier unit to apply the load that acts in the direction to press the feed roller against the plurality of sheets to the holder.

According to another aspect of the present disclosure, an image forming apparatus, having an image forming unit and a sheet conveyer, is provided. The sheet conveyer includes a tray, a feed roller, a separator roller, a holder, an arm, a load applier unit, and a cam member. The tray is configured to support a plurality of sheets. The feed roller is configured to contact one of the plurality of sheets and rotate to convey the one of the plurality of sheets in a conveying direction. The separator roller is arranged downstream from the feed roller along the conveying direction and is configured to separate the one of the plurality of sheets conveyed by the feed roller from the other of the plurality of sheets. The holder is supported swingably to swing about a rotation shaft of the separator roller and supports the feed roller rotatably. The arm extends along an axial direction of the rotation shaft of the separator roller and is engaged with the holder and configured to swing the holder. The load applier unit is configured to apply a load to the holder through the arm. The load applier unit includes a contacting member engaged with the arm, a lever movable in a vertical direction, a contractive spring engaged with the contacting member and the lever to contract in a contracting direction to pull the contacting member and the lever to be closer to each other, and a preloading member interposed between the contacting member and the lever and is configured to maintain the contractive spring in a condition stretched to be longer than a natural length. The cam member is configured to be driven by a driving source to move the lever in the vertical direction. The lever is movable by the cam member being driven between a first position, in which the lever being moved in a direction to stretch the contractive spring causes the contractive spring having been stretched by the preloading member to be further stretched to urge the contacting member and causes the load applier unit to apply a load that acts in a direction to press the feed roller against the plurality of sheets to the holder, and a second position, in which the contractive spring is maintained in a condition stretched by the preloading member without causing the load applier unit to apply the load that acts in the direction to press the feed roller against the plurality of sheets to the holder.

BRIEF DESCRIPTION OF THE ACCOMPANYING DRAWINGS

DETAILED DESCRIPTION

Hereinafter, an embodiment of the present disclosure will be described with reference to the accompanying drawings.

[Overall Configuration of Image Forming Apparatus]

Figure 1:
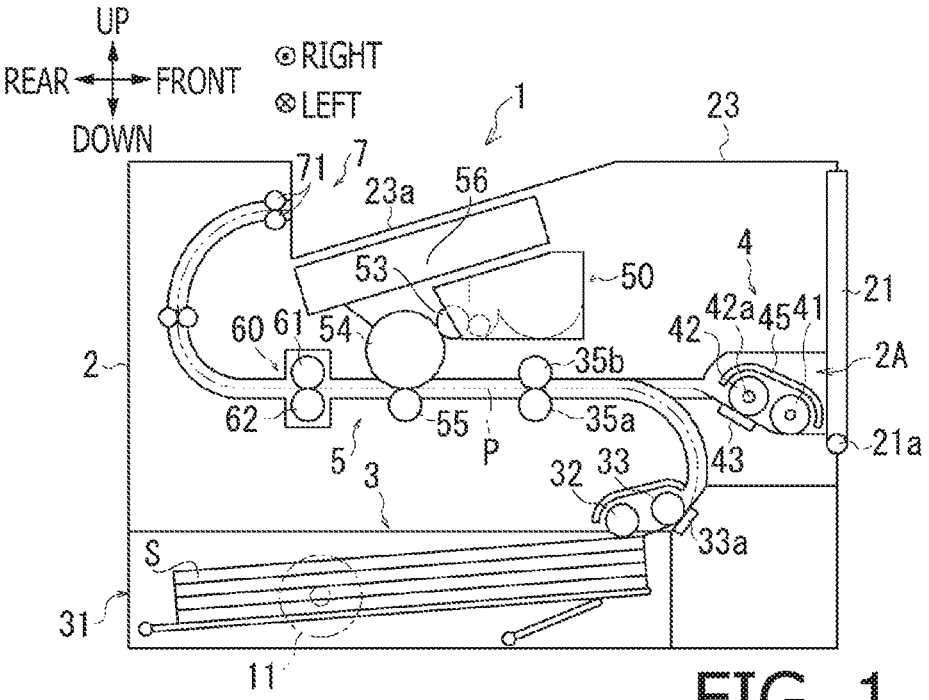
FIG. 1 is an illustrative cross-sectional view of an image forming apparatus with a sheet conveyer according to an embodiment of the present disclosure.

An image forming apparatus 1 includes, as shown in FIG. 1, a housing 2, an image forming unit 5, a sheet feeder 3, a sheet conveyer 4, and a motor 11. The image forming unit 5 may form an image on one or more sheets S. The sheet feeder 3 may feed the sheets S to the image forming unit 5. The sheet conveyer 4 may convey manually inserted sheets S toward the image forming unit 5. The motor 11 is a driving source to generate a driving force to drive movable devices in the image forming apparatus 1.

In the following description, directions related the image forming apparatus 1 and each part or item included in the image forming apparatus 1 will be mentioned on basis of a user's position to ordinarily use the image forming apparatus 1. For example, in FIG. 1, a viewer's right-hand side and left-hand side will be referred to as the user's frontward side and rearward side, respectively. A viewer's nearer side and farther side in FIG. 1 will be referred to as a rightward side and a leftward side for the user to use the image forming apparatus 1, respectively. An up-to-down or down-to-up direction in FIG. 1 may be referred to as a vertical direction, and a front-to-rear or rear-to-front direction may be referred to as a front-rear direction. Further, a left-to-right or right-to-left direction may be referred to as a widthwise direction.

The housing 2 may be in a form of a rectangular box and accommodates the sheet feeder 3, the image forming unit 5, and a sheet ejector 7. The housing 2 includes an openable section 2A, which is a room open frontward, and a multi-purpose (MP) tray 21, which is swingable to cover or expose the openable section 2A. An upper part of the housing 2 is covered by an upper cover 23.

The MP tray 21 is pivotable about a pivot axis 21*a*, which is at a lower end of the MP tray 21 and extends horizontally along the widthwise direction. The MP tray 21 is pivotable between a closure position, in which the MP tray 21 covers the openable section 2A, and an open position, in which the MP tray 21 exposes the openable section 2A. When the MP tray 21 is in the open position, the sheets S to be manually inserted may be placed on the MP tray 21. An upper face of the upper cover 23 is dented to form an ejection tray 23*a*, which inclines to be lower rearward and higher frontward.

The sheet feeder 3 includes a sheet cassette 31, a feed roller 32, a separator roller 33, a separator pad 33*a*, and paired registration rollers 35*a*, 35*b*. Inside the housing 2, formed is a conveyer path P, which extends from the sheet cassette 31 through the image forming unit 5 to the ejection tray 23*a*.

The sheet cassette 31 may support one or more sheets S therein in a stack. The sheets S supported in the sheet cassette 31 may be fed by the feed roller 32 toward the separator roller 33 and separated from one another by the separator roller 33 and the separator pad 33*a* to be conveyed in the conveyer path P one by one.

The sheets S fed in the conveyer path P may be further conveyed by the paired registration rollers 35*a*, 35*b*, which are located downstream along the conveyer path P from the separator roller 33, toward the image forming unit 5. The paired registration rollers 35*a*, 35*b* may stop a leading edge of the sheet S being conveyed for a short moment and resume conveyance of the sheet S at a predetermine timing to convey the sheet S toward a transferring position in the image forming unit 5.

The image forming unit 5 is arranged at an upper position with respect to the sheet cassette 31 and may form an image on a surface of the sheet S conveyed from the sheet feeder 3. The image forming unit 5 includes a process cartridge 50, an exposure unit 56, and a fuser unit 60. The process cartridge 50 may transfer an image on a surface of the sheet S being conveyed, the exposure unit 56 may expose the surface of the sheet S to light, and the fuser unit 60 may fix the image, which was transferred onto the sheet S in the process cartridge 50, thereon.

The process cartridge 50 includes a developer roller 53, a photosensitive drum 54, and a transfer roller 55.

The exposure unit 56 includes a laser diode, a polygon mirror, lenses, and reflector mirrors, which are not shown. The laser diode may emit a laser beam at a surface of the photosensitive drum 54 based on image data input to the image forming apparatus 1 so that the surface of the photosensitive drum 54 may be selectively exposed to the laser beam.

The photosensitive drum 54 is arranged in adjacent to the developer roller 53. The surface of the photosensitive drum 54 may be positively charged evenly by a charger, which is not shown, and may be selectively exposed to the laser beam in the exposure unit 56 according to the image data. Potential in the area exposed to the laser beam may be lowered to form an electrostatic latent image on the photosensitive drum 54. Thereafter, positively charged toner may be supplied to the electrostatic latent image on the photosensitive drum 54 by the developer roller 53 so that the electrostatic image may be developed to be a toner image.

The transfer roller 55 is arranged to face the photosensitive drum 54. A bias applier, which is not shown, may apply negative transferring bias to a surface of the transfer roller 55. The sheet may be conveyed through the transferring position between the transfer roller 55, of which surface is negatively biased, and the photosensitive drum 55, on which the developed toner image is carried, so that the toner image carried on the photosensitive drum 54 may be transferred to the surface of the sheet S.

The fuser unit 60 includes a heat roller 61 and a pressure roller 62. The heat roller 61 may rotate by the driving force from the motor 11 and may be heated by electricity supplied from an electric power source, which is not shown. The pressure roller 62 is arranged to face and contact the heat roller 61 and may be driven to rotate by rotation of the heat roller 61. As the sheet S with the transferred toner image thereon enters the fuser unit 60, the sheet S is conveyed through a position between the heat roller 61 and the pressure roller 62 so that the toner image may be fixed at the surface of the sheet S.

The sheet ejector 7 includes paired ejector rollers 71, 71 to eject the sheet S conveyed from the fuser unit 60 outside the housing 2. Specifically, the paired ejector rollers 71, 71 may further convey the sheet S conveyed from the fuser unit 60 to rest in the ejection tray 23*a* formed on the upper side of the upper cover 23.

Figure 2:
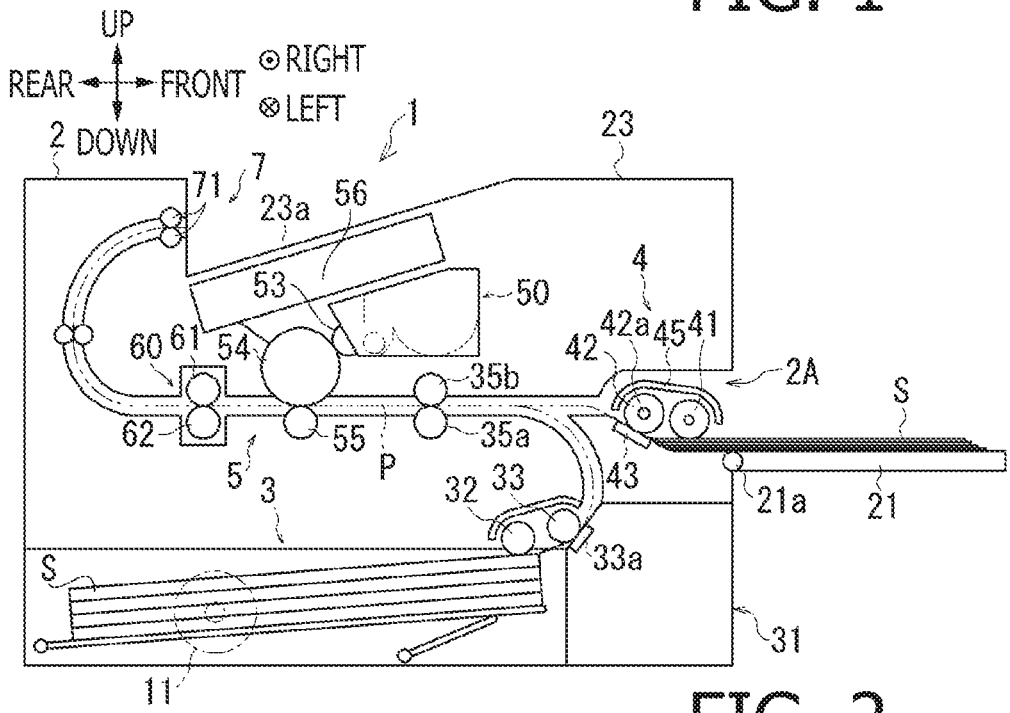
FIG. 2 is an illustrative cross-sectional view of the image forming apparatus with a multi-purpose (MP) tray being in an open position according to the embodiment of the present disclosure.

The sheet conveyer 4 is, as shown in FIG. 2, disposed in the openable section 2A to convey the sheets S inserted manually through the MP tray 21 toward the image forming unit 5.

[Sheet Conveyer]

Below will be described the sheet conveyer 4. The sheet conveyer 4 includes, as shown in FIG. 2, the MP tray 21, a feed roller 41, a separator roller 42, a separator pad 43, the motor 11, a holder 45, and an arm 46. The MP tray 21 may support one or more sheets S thereon in a stack. The feed roller 41 may contact the sheets S on the MP tray 21 and rotate to feed the sheets S to the separator roller 42. The separator roller 42 is arranged at a downstream position from the feed roller 41 along a conveying direction for the sheets S to be conveyed. The separator pad 43 is arranged to face the separator roller 42. The motor 11 may supply a driving force to the feed roller 41 and the separator roller 42. The holder 45 supports the feed roller 41. The arm 46 extends along an axial direction of a rotation shaft 42*a* of the separator roller 42.

The separator roller 42 is rotatably supported by the housing 2 to rotate about the rotation shaft 42*a*. The separator roller 42 may separate the sheets S fed by the feed roller 41 from one another in conjunction with the separator pad 43 and convey the separated sheet S downstream in the conveying direction.

Figure 3:
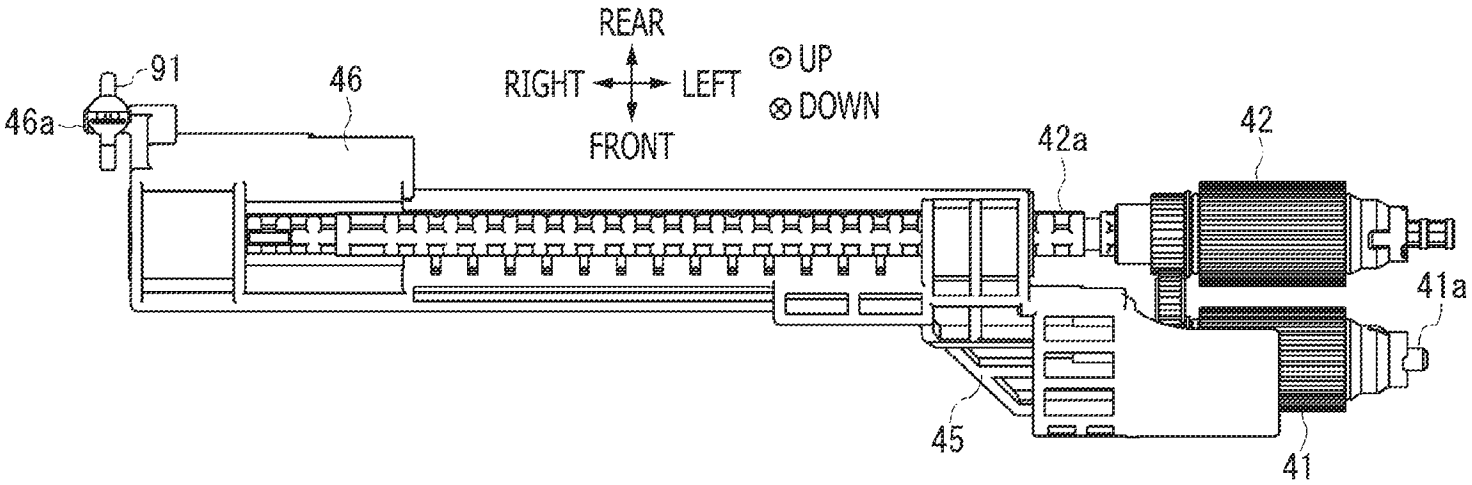
FIG. 3 is a plan view of a separator roller, a feed roller, an arm, and a holder in the sheet conveyer according to the embodiment of the present disclosure.
Figure 4:
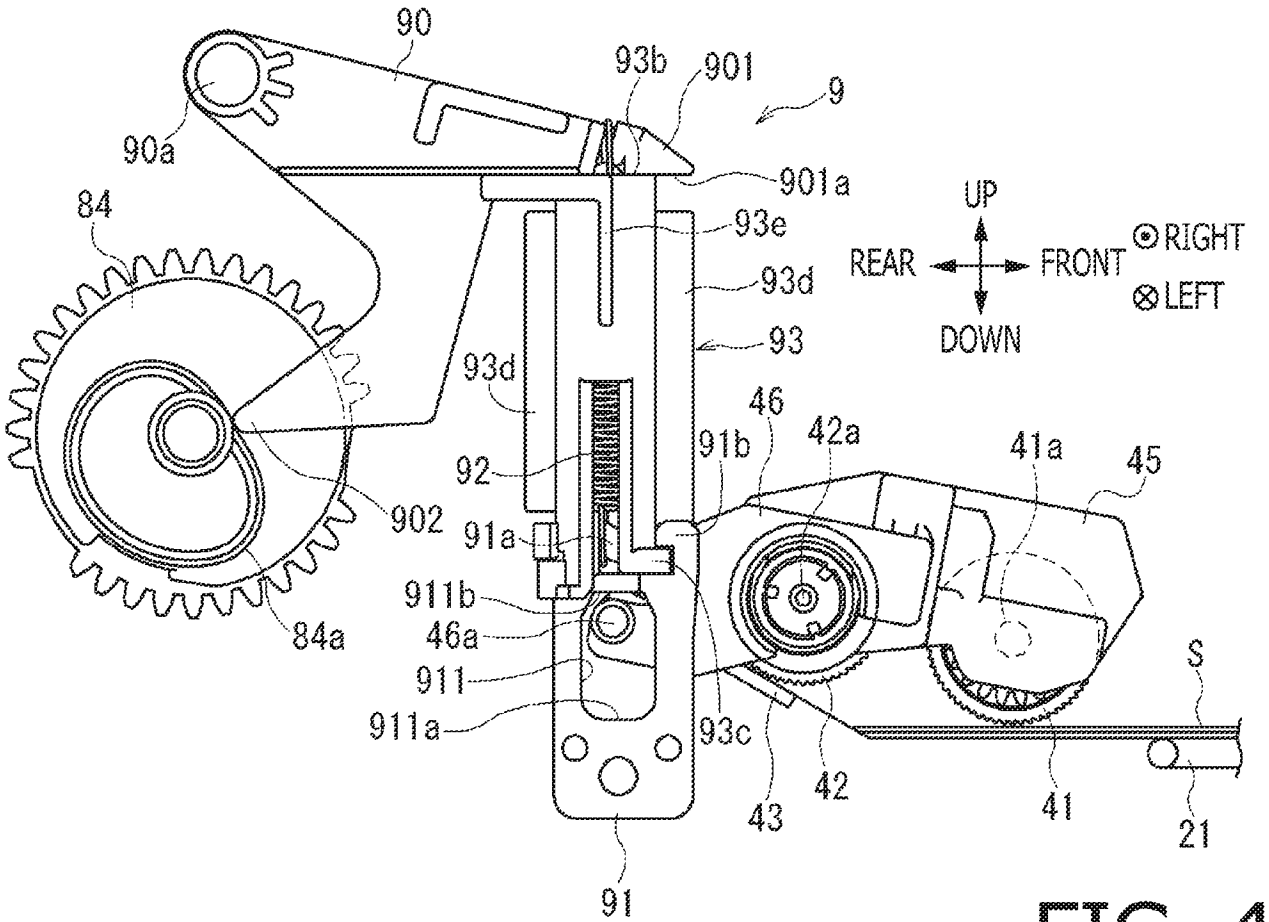
FIG. 4 is a sideward view of the sheet conveyer according to the embodiment of the present disclosure with a lever being in a second position.

The holder 45 is, as shown in FIGS. 3 and 4, swingably supported by the rotation shaft 42*a* of the separator roller 42 to swing about the rotation shaft 42*a*. Further, the holder 45 supports the feed roller 41 rotatably so that the feed roller 41 may rotate about a rotation shaft 41*a* of the feed roller 41. The feed roller 41, the separator roller 42, and the holder 45 are arranged in a widthwise central area in the sheet conveyer 4. The rotation shaft 42*a* of the separator roller 42 extends rightward from the separator roller 42 to reach a rightward end area of the sheet conveyer 4.

The feed roller 41 is located frontward from the rotation shaft 42*a* of the separator roller 42. The holder 45 supports the separator roller 42 rotatably, at an intervening position between a protrusion 46*a* and the feed roller 41 with regard to the front-rear direction, so that the separator roller 42 may rotate about the rotation shaft 42*a*. As the holder 45 swings about the rotation shaft 42*a* of the separator roller 42, the feed roller 41 and the arm 46 swing about the rotation shaft 42*a* integrally along with the holder 45.

The arm 46 is engaged with the holder 45 and extends rightward from the holder 45. At a rightward end of the arm 46, formed is the protrusion 46*a* protruding rightward. The protrusion 46*a* is located rearward from the rotation shaft 42*a* of the separator roller 42 with regard to the front-rear direction. The arm 46 may swing the holder 45 about the rotation shaft 42*a* while the protrusion 46*a* moves vertically.

The feed roller 41 is swingable about the rotation shaft 42*a* to drop downward due to a weight thereof by an effect of gravity, when substantially no external force is applied to the holder 45, and contact the sheets S supported by the MP tray 21. On the other hand, when the protrusion 46*a* is subjected to a load that may lift the protrusion 46*a* upward, the holder 45 is subjected to a force that may act in a direction to swing the feed roller 41 about the rotation shaft 42*a* further downward. Thus, the feed roller 41 may be pressed against the sheets S supported by the MP tray 21. In other words, when a load in an upward direction is applied to the protrusion 46*a*, a load acting in a direction to press the feed roller 41 against the sheet S supported on the MP tray 21 may be applied to the holder 45.

Figure 5:
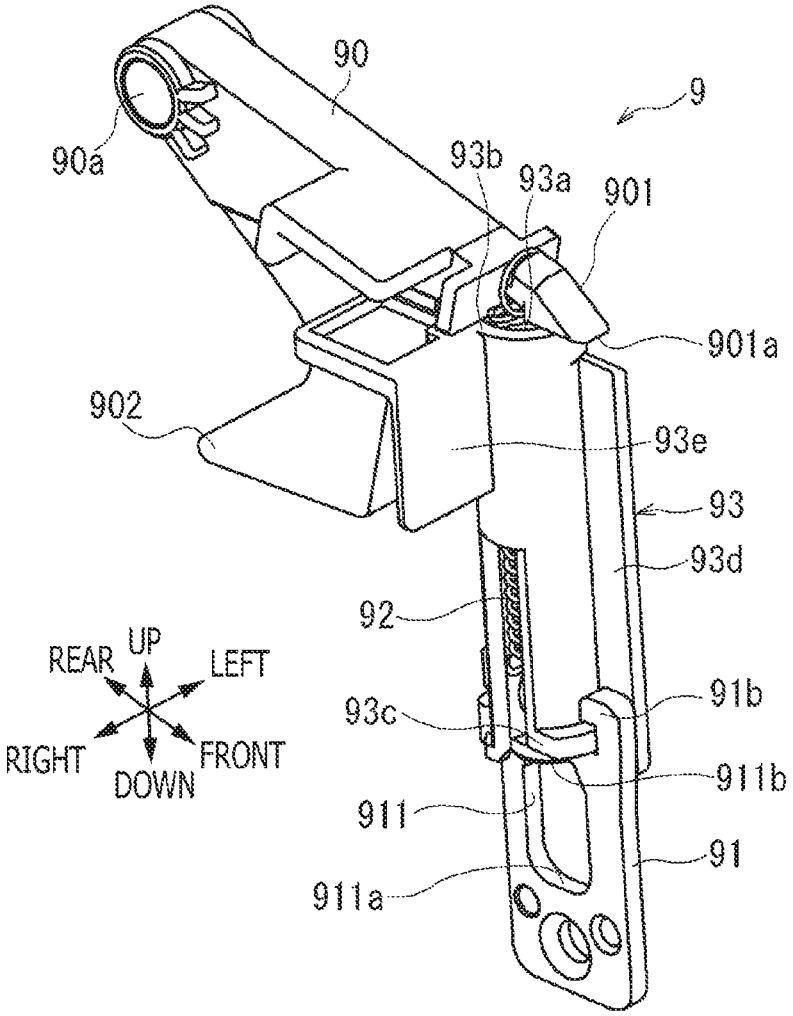
FIG. 5 is a perspective view of a load applier unit in the sheet conveyer according to the embodiment of the present disclosure.
Figure 6:
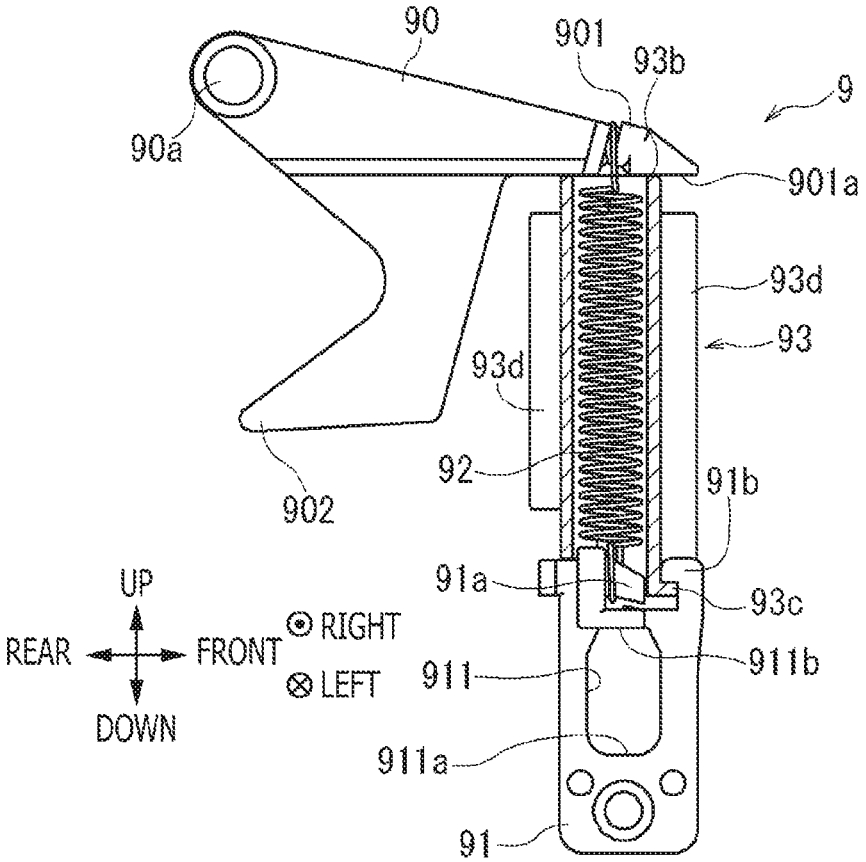
FIG. 6 is a cross-sectional view of the load applier unit in the sheet conveyer according to the embodiment of the present disclosure.

As shown in FIGS. 4-6, the sheet conveyer 4 includes a contacting member 91, a lever 90, a contractive spring 92, a preloading member 93, and a cam member 84. The contacting member 91 is engageable with the protrusion 46*a* of the arm 46. The lever 90 is movable in the vertical direction. The contractive spring 92 is interposed between the contacting member 91 and the lever 90. The preloading member 93 is interposed between the contacting member 91 and the lever 90 to hold the contractive spring 92 in a stretched condition to be longer than a natural length. The cam member 84 may be driven by the motor 11 to rotate.

The contractive spring 92 is engaged with an engageable section 901 of the lever 90 at a first end, e.g., an upper end in FIG. 4, and with an engageable section 91*a* of the contacting member 91 at a second end, e.g., a lower end in FIG. 4. The contractive spring 92 may contract to pull the lever 90 and the contacting member 91 to be closer to each other. A load applier unit 9, which may apply a load through the arm 46 to the holder 45, includes the contacting member 91, the lever 90, the contractive spring 92, and the preloading member 93.

The lever 90 is swingable about a swing axis 90*a*. A swinging movement of the lever 90 may move the engageable section 901 engaged with the contractive spring 92 in the vertical direction. Meanwhile, the cam member 84 includes a cam section 84*a*, and the lever 90 includes a contact section 902, at which the lever 90 contacts the cam section 84*a*.

The lever 90 is movable, when the cam member 84 is driven to rotate, between a first position, in which the engageable section 901 is moved upward by the cam section 84*a* (see FIG. 8), and a second position, in which the engageable section 901 is moved downward by the cam section 84*a* (see FIG. 4).

The preloading member 93 is formed in a tubular shape, in which a through hole 93*a* to accommodate the contractive spring 92 extends in the vertical direction. When the lever 90 is in the second position, an upper-end face 93*b* of the preloading member 93 contacts a lower face 901*a* of the engageable section 901 in the lever 90. In other words, the lower face 901*a* of the engageable section 901 in the lever 90 may contact the preloading member 93 when the lever 90 is in the second position. Meanwhile, a lower-end section 93*c* of the preloading member 93 is coupled with a coupling section 91*b* formed at an upper end of the contacting member 91. The lower-end section 93*c* and the coupling section 91*b* serve as a coupler to couple the preloading member 93 and the contacting member 91 with each other when the lever 90 is in the first position and in the second position.

The preloading member 93, with the upper-end face 93*b* contacting the lower face 901*a* of the engageable section 901, and with the lower-end section 93*c* coupled with the coupling section 91*b* of the contacting member 91, maintains a distance between the engageable section 901 and the coupling section 91*b* constant. This distance keeps the contractive spring 92, which is interposed between the engageable section 901 and the coupling section 91*b*, to stay stretched to be longer than the natural length. Thus, the contractive spring 92 may be maintained in the condition, in which an urging force in a contracting direction is produced.

While the preloading member 93 is interposed between the engageable section 901 and the coupling section 91*b*, the urging force is produced between the engageable section 901 and the coupling section 91*b* in a direction to be closer to each other. With this urging force, the lower face 901*a* of the engageable section 901 may be pressed against the upper-end face 93*b* of the preloading member 93.

The preloading member 93 accommodates the contractive spring 92 in the through hole 93*a*. In other words, an outer periphery of the contractive spring 92 is covered by the preloading member 93. Therefore, when, for example, the contractive spring 92 once stretched is contracting, the contractive spring 92 may be prevented from being tangled with or caught by items arranged around the outer periphery of the contracting spring 92.

The contacting member 91 has a hole section including an elongated hole 911, which extends in the vertical direction and is engageable with the protrusion 46*a*. A lower edge of the elongated hole 911 is located to be lower than the protrusion 46*a* and serves as an engageable section 911*a*, which is engageable with the protrusion 46*a* when the lever 90 is at the first position. When the lever 90 is at the second position, the engageable section 911*a* and an upper edge 911*b* of the elongated hole 911 may be both separated from the protrusion 46*a*. In this regard, it may be noted that the elongated hole 911 and the protrusion 46*a* may not necessarily be arranged in the contacting member 91 and the arm 46, respectively, but the arrangement may be inverted. In other words, the arm 46 may have an elongated hole, and the contacting member 91 may have a protrusion to engage with the elongated hole in the arm 46. In this arrangement, an upper edge of the elongated hole may serve as the engageable section of the elongated hole to engage with the protrusion when the lever 90 is in the first position. Further, the elongated hole 911 may not necessarily be elongated to be longer in the vertical direction but may be, for example, a square hole as long as the protrusion 46*a* is engageable with the hole, and the upper edge and the lower edge of the hole are both separated from the protrusion 46*a* when the lever 90 is at the second position.

In the sheet conveyer 4 configured as above, when the cam member 84 rotates to a rotational position shown in FIG. 4, the lever 90 may swing in a direction to move the engageable section 901 downward to the second position.

When the lever 90 is in the second position, the contacting member 91 is lowered, and the engageable section 911*a* is separated from the protrusion 46*a*. In the state where the engageable section 911*a* is separated from the protrusion 46*a*, substantially no load may be applied by the contacting member 91 to the protrusion 46*a*. Therefore, the feed roller 41 may swing downward by a weight thereof to contact an upper surface of the sheet S supported on the MP tray 21. Meanwhile, the contractive spring 92 may be maintained in the stretched condition by the preloading member 93.

In other words, while the lever 90 is in the second position, the contractive spring 92 may be maintained stretched by the preloading member 93, and the load applier unit 9 may apply substantially no load in the direction to press the feed roller 41 against the sheet S to the holder 45.

Thus, the lever 90 being in the second position may cause the protrusion 46*a* to be separated from the engageable section 911*a* of the contacting member 91. Therefore, for example, when the feed roller 41 is placed to contact the upper surface of the MP tray 21 merely by the weight thereof, the feed roller 41 may be lifted upward manually to be separated from the MP tray 21, and the sheets S to be placed on the MP tray 21 may be inserted in a position between the MP tray 21 and the feed roller 41 easily.

In other words, the feed roller 41 may swing in a direction to be separated away from the MP tray 21 for a distance equal to a separated distance between the protrusion 46*a* and the engageable section 911*a*. Therefore, when a bundle of sheets S are inserted in a gap between the MP tray 21 and the feed roller 41, the sheets S may not necessarily be pushed into the gap forcibly with a larger amount of pressure but may be inserted in the gap easily without being bended.

Figure 7:
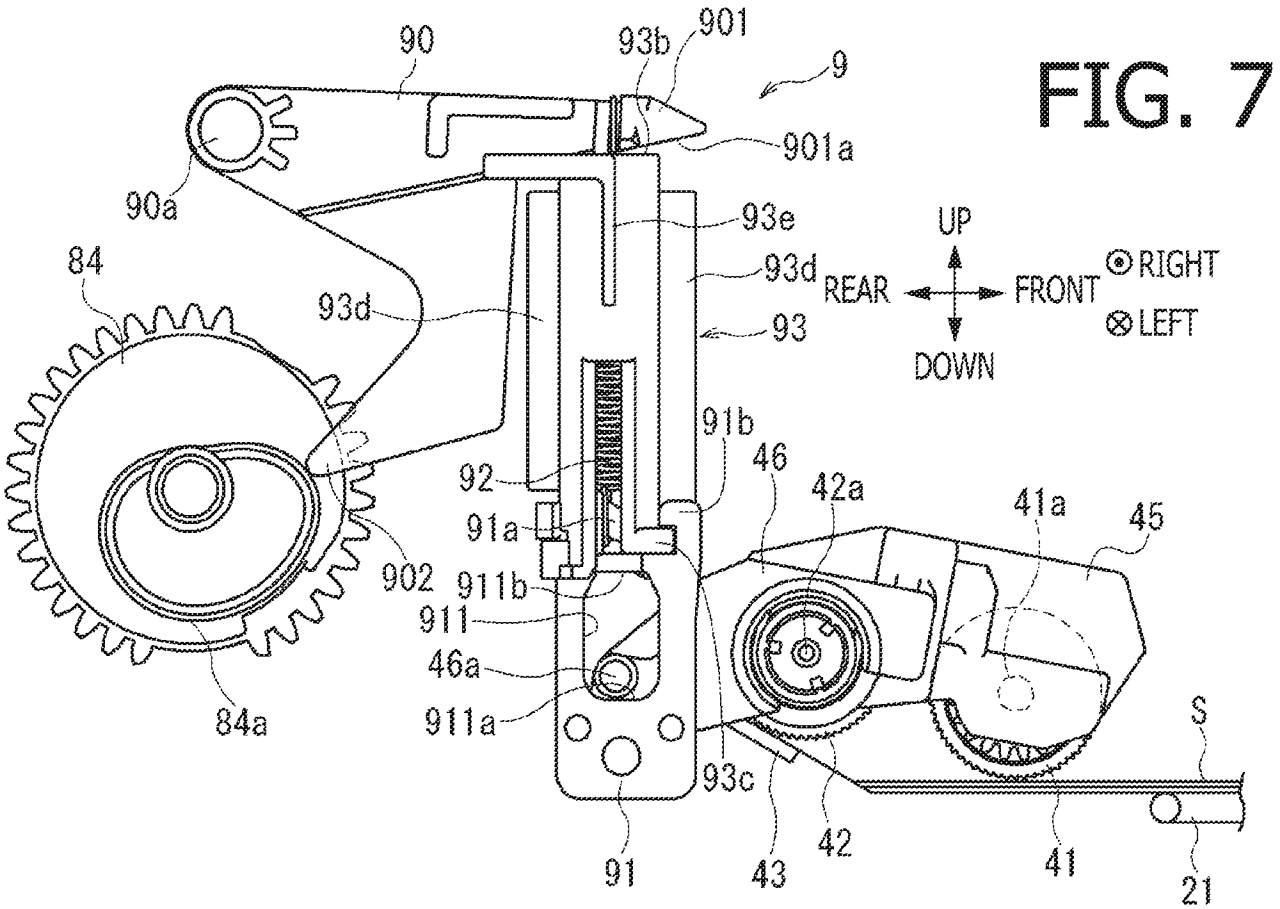
FIG. 7 is a sideward view of the load applier lever moved upward from the second position, with an engageable section of an elongated hole in a contacting member contacting a protrusion of an arm, according to the embodiment of the present disclosure.

When the lever 90 is moved by rotation of the cam member 84 from the second position to swing in a direction, in which the engageable section 901 moves upward, as shown in FIG. 7, the contacting member 91 likewise moves upward, and the engageable section 911*a* of the elongated hole 911 may contact the protrusion 46*a*. In this condition, the contractive spring 92 may be maintained stretched by the preloading member 93, and substantially no load to press the feed roller 41 against the sheet S is applied by the load applier unit 9 to the holder 45.

When the cam member 84 rotates further and the lever 90 swings further in the direction to move the engageable section 901 upward to the first position, the contractive spring 92 may be stretched further by the lever 90 than the stretched condition stretched by the preloading member 93, and the contacting member 91 may be urged upward. As the contacting member 91 is urged upward, the load to act in the direction to press the feed roller 41 against the sheet S is applied by the load applier unit 9 to the holder 45.

Thus, when the lever 90 is moved in the direction to stretch the contractive spring 92 to be located in the first position, the contractive spring 92 having been stretched antecedently by the preloading member 93 may be further stretched to urge the contacting member 91 so that the load to act in the direction to press the feed roller 41 against the sheet S may be applied to the holder 45.

In this way, the contractive spring 92 is set in the stretched condition by the preloading member 93 before the lever 90 is moved to the first position. Therefore, a substantial amount of the urging force to press the feed roller 41 against the sheet S to convey the sheet S may be produced in the contractive spring 92 even with a small amount of stroke to pull the contractive spring 92 when the lever 90 is moved to the first position. Thus, with the reduced amount of stroke, the sheet conveyer 4 may be downsized.

Meanwhile, while the contractive spring 92 is maintained preliminarily in the stretched condition to be longer than the natural length by the preloading member 93. Therefore, compared to a condition, in which the contractive spring 92 is not stretched preliminarily, a value for a constant k in Hooke' law ($F=kx$), which is required to achieve the urging force F, may be set to a lower value. Accordingly, while a contractive amount x in the contractive spring 92 may individually vary, a variable range for the load to be applied to the feed roller 41 may be prevented from increasing.

Figure 8:
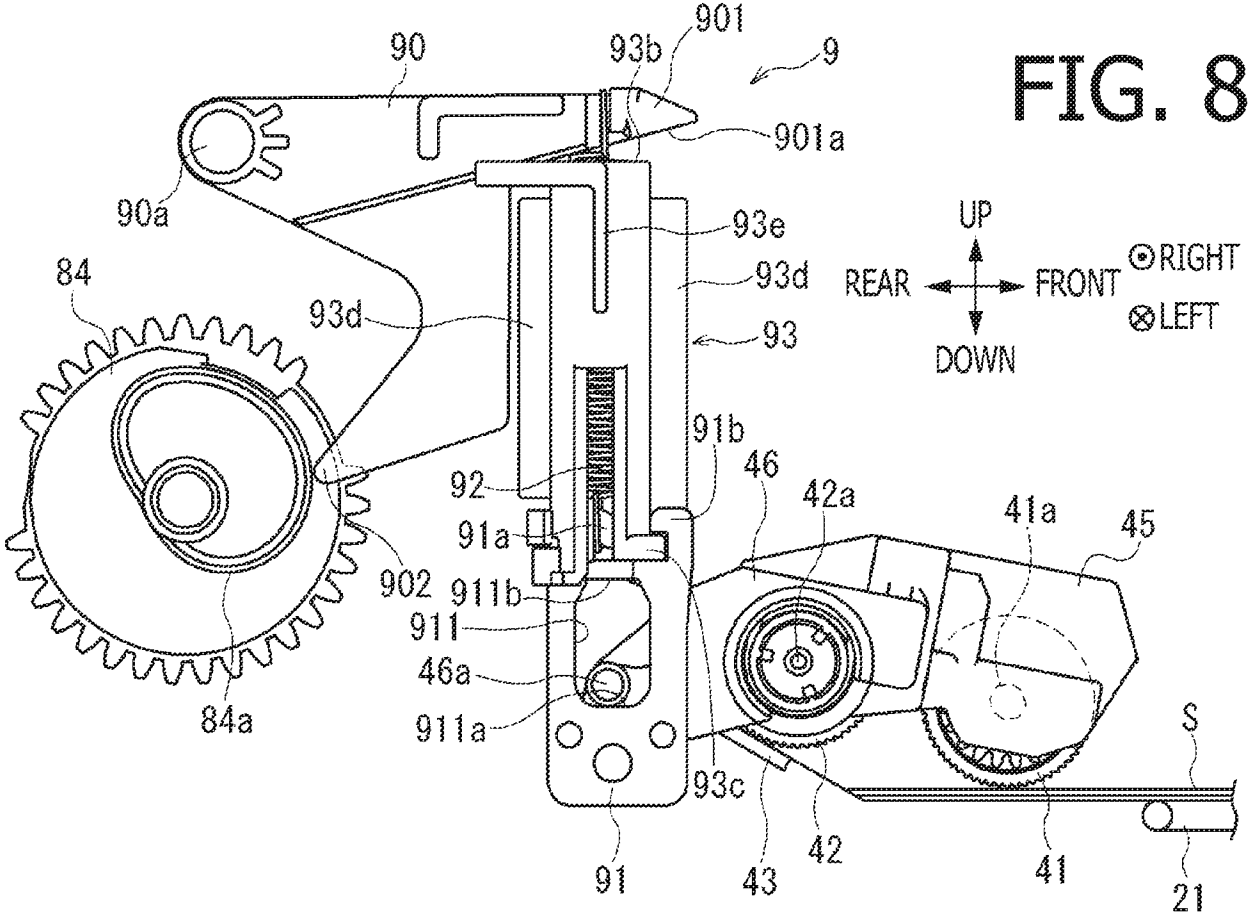
FIG. 8 is a sideward view of the sheet conveyer according to the embodiment of the present disclosure with the lever being in a first position.

Further, when the lever 90 moves to the first position, as shown in FIG. 8, the lever 90 may stretch the contractive spring 92 to be longer than the preliminarily stretched length stretched by the preloading member 93. Meanwhile, the lower face 901*a* of the engageable section 901 in the lever 90 may separate from the upper-end face 93*b* of the preloading member 93.

Thus, when the lever 90 is in the first position, a gap may be formed between the lower face 901*a* of the lever 90 and the upper-end face 93*b* of the preloading member 93. In other words, the lower face 901*a* of the lever 90 and the upper-end face 93*b* of the preloading member 93 may not interfere with each other. Therefore, the preloading member 93 may be prevented from being tilted in a direction to intersect with the stretching direction of the contractive spring 92 or from contacting the contractive spring 92. Thus, the load to be applied to the feed roller 41 by the urging force of the contractive spring 92 may be maintained steady.

Further, the lower-end section 93*c* of the preloading member 93 is coupled with the coupling section 91*b* of the contacting member 91. Therefore, when the lever 90 moves to the first position, in which the contractive spring 92 is stretched further to be longer than the length preliminarily stretched by the preloading member 93, the lower-end section 93*c* of the preloading member 93 may be prevented from being displaced from a position of the coupling section 91*b* of the contacting member 91, and the preloading member 93 may be prevented from contacting the contractive spring 92.

Figure 9:
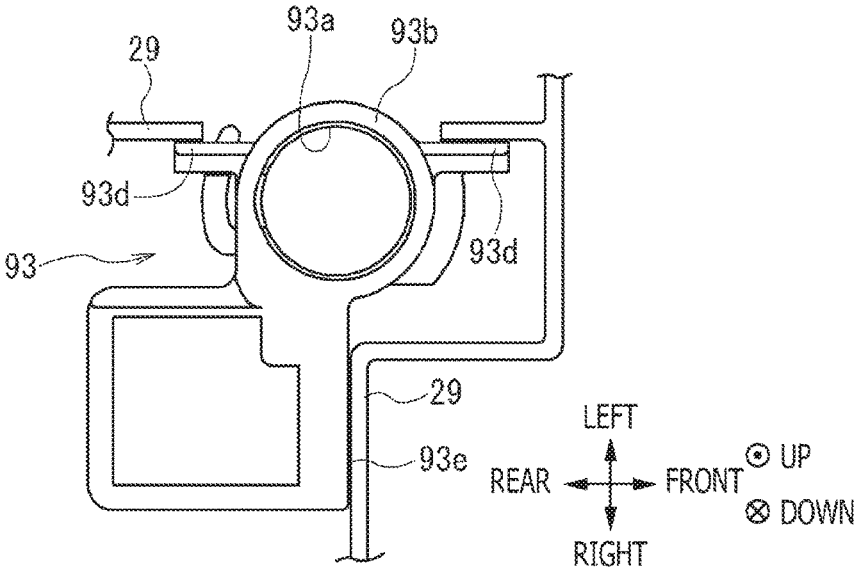
FIG. 9 is a plan view of a preloading member in the sheet conveyer according to the embodiment of the present disclosure.

As shown in FIG. 9, the preloading member 93 includes restrictor sections 93*d*, 93*e*, which may restrict the preloading member 93 from moving in the direction to intersecting with the stretching direction of the contractive spring 92. While the sheet conveyer 4 has a frame 29 arranged around the preloading member 93, the restrictor sections 93*d*, 93*e* may contact the frame 29 to restrict the preloading member 93 from moving in the direction to intersect with the stretching direction of the contractive spring 92. The restrictor section 93*d* may, for example, restrict the preloading member 93 from moving in the widthwise direction, and the restrictor section 93*e* may restrict the preloading member 93 from moving in the front-rear direction.

Thus, the restrictor sections 93*d*, 93*e* may prevent the preloading member 93 from moving in the directions to intersect with the stretching direction of the contractive spring 92 so that the preloading member 93 may be prevented from tilting in the direction to intersect with the stretching direction of the contractive spring 92. Accordingly, the preloading member 93 may be prevented from contacting the contractive spring 92.

Figure 10:
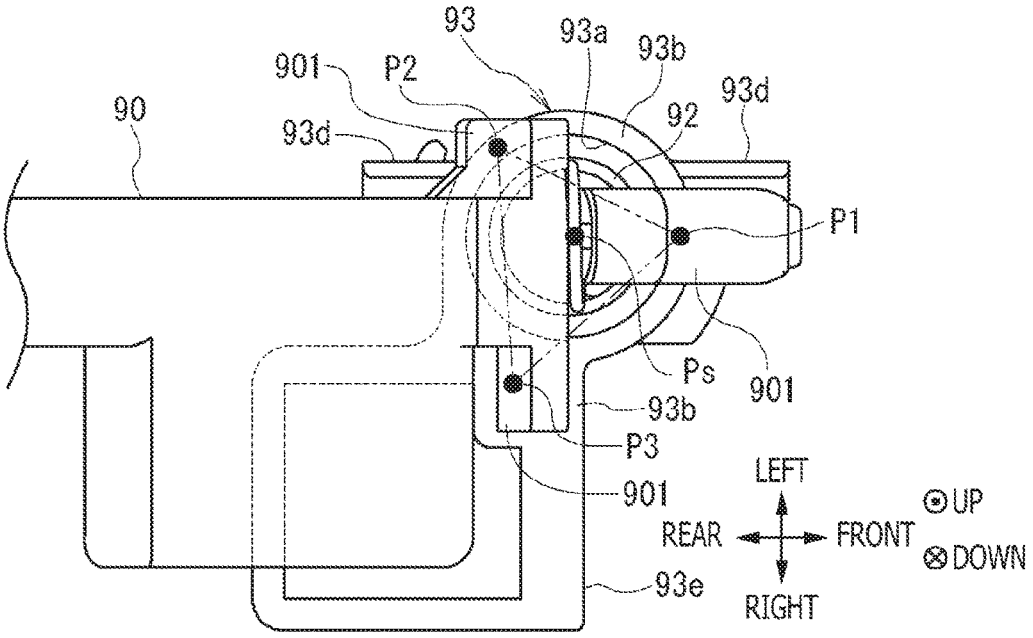
FIG. 10 is a plan view to illustrate engagement points between a lower face of the engageable section in the lever and an upper-end face of the preloading member in the sheet conveyer according to the embodiment of the present disclosure.

Meanwhile, as shown in FIGS. 4 and 10, the upper-end face 93*b* of the preloading member 93 and the lower face 901*a* of the engageable section 901 in the lever 90 contact each other to be engaged with each other when the lever 90 is in the second position. The upper-end face 93*b* and the lower face 901 engage with each other on a plane that spreads orthogonally to the contracting direction of the contractive spring 92. In particular, the lower face 901*a* and the upper-end face 93*b* may engage with each other at three points: a first engagement point P1, a second engagement point P2, and a third engagement point P3.

At areas on the upper-end face 93*b* at the positions of the first engagement point P1, the second engagement point P2, and the third engagement points P3 and areas on the lower face 901 at the positions of the first engagement point P1, the second engagement point P2, and the third engagement points P3, provided are an engaging structure and an engageable structure. The engaging structure may engage one of the preloading member 93 and the lever 90 with the other of the preloading member 93 and the lever 90, and the engageable structure may be engaged with the engaging structure on a plane spreading orthogonally to the contracting direction of the contractive spring 92.

Meanwhile, an engagement point Ps, at which the engageable section 901 of the lever 90 is engaged with the first end of the contractive spring 92, is located in an area defined by lines that connect adjoining ones of the first engagement point P1, the second engagement point P2, and the third engagement point P3 with one another on the plane spreading orthogonally to the contracting direction of the contractive spring 92. For example, the engagement point Ps is located in an area defined by dash-and-double-dots lines in FIG. 10. Meanwhile, an engagement point, at which the contacting member 91 is engaged with the second end of the contractive spring 92, is located in the area defined by lines that connect adjoining ones of the first engagement point P1, the second engagement point P2, and the third engagement point P3 with one another on a plane spreading orthogonally to the contracting direction of the contractive spring 92.

In other words, the contractive spring 92 that engages with the lever 90 and with the contacting member 91 is located in the area defined by the lines that connect adjoining ones of the first engagement point P1, the second engagement point P2, and the third engagement point P3 with one another on a plane spreading orthogonally to the contracting direction of the contractive spring 92. In this arrangement, the preloading member 93 may be prevented from tilting in the direction to intersect with the stretching direction of the contractive spring 92 and from contacting the contractive spring 92.

It may be noted that the engagement points between the upper-end face 93*b* and the lower face 901*a* may not necessarily be limited to the first, second, and third engagement points P1, P2, P3, but the upper-end face 93*b* and the lower face 901*a* may engage with each other at some more points additionally to the first, second, and third engagement points P1, P2, P3.

[Benefits]

The image forming apparatus 1 according to the embodiment has the sheet conveyer 4, which includes the MP tray 21; the feed roller 41; the separator roller 42; the holder 45; the arm 46; the load applier unit 9 including the contacting member 91, the lever 90, the contractive spring 92, and the preloading member 93; and the cam member 84. The lever 90 is movable by the cam member 84 being driven between the first position, in which the lever 90 being moved in the direction to stretch the contractive spring 92 causes the contractive spring 92 having been stretched by the preloading member 93 to be further stretched to urge the contacting member 91 and causes the load applier unit 9 to apply the load that acts in the direction to press the feed roller 41 against the sheets S to the holder 45, and the second position, in which the contractive spring 92 is maintained in the stretched condition stretched by the preloading member 93 without causing the load applier unit 9 to apply the load that acts in the direction to press the feed roller 41 against the sheets S to the holder 45.

With this configuration, the contractive spring 92 is maintained in the stretched condition preliminarily by the preloading member 93. Therefore, a substantial amount of the urging force to press the feed roller 41 against the sheet S to convey the sheet S may be produced in the contractive spring 92 even with a small amount of stroke to pull the contractive spring 92 when the lever 90 is moved to the first position. Thus, with the reduced amount of stroke, the sheet conveyer 4 may be downsized.

The contractive spring 92 is maintained preliminarily in the stretched condition to be longer than the natural length by the preloading member 93. Therefore, compared to a condition, in which the contractive spring 92 is not stretched preliminarily, a value for a constant k in Hooke' law (F=kx), which is required to achieve the urging force F, may be set to a lower value. Accordingly, even when a contractive amount x in the contractive spring 92 may vary, a variable range for the amount of the load to be applied to the feed roller 41 may be prevented from being enlarged.

Meanwhile, the protrusion 46*a* may be formed in one of the contacting member 91 and the arm 46, and the elongated hole 911, elongated along the swingable direction of the arm 46 and engaged with the protrusion 46*a* may be formed in the other of the contacting member 91 and the arm 46.

When sheets S are inserted in a gap between the MP tray 21 and the feed roller 41, the feed roller 41 may move in the direction to be separated from the MP tray 21 for the length equivalent to the length of the elongated hole 911. Therefore, the sheets S may not necessarily be pushed into the gap forcibly with a larger amount of pressure but may be inserted in the gap easily without being bended.

Meanwhile, the lever 90 may include the lower face 901, which is separated from the preloading member 93 when the lever 90 is in the first position and contacts the preloading member 93 when the lever 90 is in the first position.

When the lever 90 is in the first position, a gap may be formed between the lower face 901*a* of the lever 90 and the upper-end face 93*b* of the preloading member 93. In other words, the lower face 901*a* of the lever 90 and the upper-end face 93*b* of the preloading member 93 may not interfere with each other. Therefore, the preloading member 93 may be prevented from being tilted in a direction to intersect with the stretching direction of the contractive spring 92 or from contacting the contractive spring 92. Thus, the load to be applied to the feed roller 41 by the urging force of the contractive spring 92 may be maintained steady.

Meanwhile, the preloading member 93 and the contacting member 91 may be coupled with each other through a coupler, which includes the lower-end section 93*c* and the coupling section 91*b*.

Therefore, when the contractive spring 92 is stretched further than the length preliminarily stretched by the preloading member 93, the lower-end section 93*c* of the preloading member 93 may be prevented from being displaced from a position of the coupling section 91*b* of the contacting member 91, and the preloading member 93 may be prevented from contacting the contractive spring 92.

Meanwhile, the preloading member 93 may include the restrictor sections 93*d*, 93*e*, which are configured to restrict the preloading member 93 from moving in the direction to intersect with the stretching direction of the contractive spring 92.

Therefore, the preloading member 93 may be prevented from tilting in the direction to intersect with the stretching direction of the contractive spring 92 and may be prevented from contacting the contractive spring 92.

Meanwhile, the preloading member 93 may have the through hole 93*a*, in which the contractive spring 92 is accommodated.

The outer periphery of the contractive spring 92 is covered by the preloading member 93. Therefore, when the contractive spring 92 once stretched is contracting, the contractive spring 92 may be prevented from being caught by or tangled with items arranged around the outer periphery of the contracting spring 92.

Meanwhile, the lever 90 may include the lower face 901*a*, and the preloading member 93 may include the upper-end face 93*b* to engage with the lower face 901*a* on the plane spreading orthogonally to the contracting direction of the contractive spring 92 at at least three points, including the first engagement point P1, the second engagement point P2, and the third engagement point P3. The contractive spring 92 may be located in the area defined by lines that connect adjoining ones of the first, second, and third engagement points P1, P2, P3 with one another on the plane.

Therefore, the preloading member 93 may be prevented from tilting in the direction to intersect with the stretching direction of the contractive spring 92 and may be prevented from contacting the contractive spring 92.

Although an example of carrying out the invention has been described, those skilled in the art will appreciate that there are numerous variations and permutations of the sheet conveyer and the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

What is claimed is:

1. A sheet conveyer, comprising:

a tray configured to support a plurality of sheets;

a feed roller configured to contact one of the plurality of sheets and rotate to convey the one of the plurality of sheets in a conveying direction;

a separator roller arranged downstream from the feed roller along the conveying direction, the separator roller being configured to separate the one of the plurality of sheets conveyed by the feed roller from the other of the plurality of sheets;

a holder supported swingably to swing about a rotation shaft of the separator roller, the holder supporting the feed roller rotatably;

an arm extending along an axial direction of the rotation shaft of the separator roller, the arm being engaged with the holder and configured to swing the holder;

a load applier unit configured to apply a load to the holder through the arm, the load applier unit comprising:

a contacting member engaged with the arm;

a lever movable in a vertical direction;

a contractive spring engaged with the contacting member and the lever, the contractive spring being configured to contract in a contracting direction to pull the contacting member and the lever to be closer to each other; and a preloading member interposed between the contacting member and the lever, the preloading member being configured to maintain the contractive spring in a condition stretched to be longer than a natural length; and a cam member configured to be driven by a driving source to move the lever in the vertical direction, wherein the lever is movable by the cam member being driven between:

a first position, in which the lever being moved in a direction to stretch the contractive spring causes the contractive spring having been stretched by the preloading member to be further stretched to urge the contacting member and causes the load applier unit to apply a load that acts in a direction to press the feed roller against the plurality of sheets to the holder; and a second position, in which the contractive spring is maintained in a condition stretched by the preloading member without causing the load applier unit to apply the load that acts in the direction to press the feed roller against the plurality of sheets to the holder.

2. The sheet conveyer according to claim 1, wherein one of the contacting member and the arm has a protrusion; and wherein the other of the contacting member and the arm has a hole, the hole extending along a swingable direction of the arm and engaged with the protrusion.

3. The sheet conveyer according to claim 1, wherein the lever comprises a contacting section, the contacting section being configured to be separated from the preloading member when the lever is in the first position and to contact the preloading member when the lever is in the first position.

4. The sheet conveyer according to claim 1, wherein the preloading member and the contacting member are coupled with each other through a coupler.

5. The sheet conveyer according to claim 1, wherein the preloading member comprises a restrictor configured to restrict the preloading member from moving in a direction to intersect with the direction to stretch the contractive spring.

6. The sheet conveyer according to claim 1, wherein the preloading member has a through hole, in which the contractive spring is accommodated.

7. The sheet conveyer according to claim 1, wherein one of the lever and the preloading member has an engaging section;

wherein the other of the lever and the preloading member has an engageable section, the engageable section being engageable with the engaging section on a plane spreading orthogonally to the contracting direction of the contractive spring;

wherein the engaging section and the engageable section are each formed at at least three points on the plane; and wherein the contractive spring is located in an area defined by lines that connect adjoining ones of the engaging sections with one another on the plane.

8. An image forming apparatus, comprising:

an image forming unit; and a sheet conveyer, the sheet conveyer comprising:

a tray configured to support a plurality of sheets;

a feed roller configured to contact one of the plurality of sheets and rotate to convey the one of the plurality of sheets in a conveying direction;

a separator roller arranged downstream from the feed roller along the conveying direction, the separator roller being configured to separate the one of the plurality of sheets conveyed by the feed roller from the other of the plurality of sheets;

a holder supported swingably to swing about a rotation shaft of the separator roller, the holder supporting the feed roller rotatably;

an arm extending along an axial direction of the rotation shaft of the separator roller, the arm being engaged with the holder and configured to swing the holder;

a load applier unit configured to apply a load to the holder through the arm, the load applier unit comprising:

a contacting member engaged with the arm;

a lever movable in a vertical direction;

a contractive spring engaged with the contacting member and the lever, the contractive spring being configured to contract in a contracting direction to pull the contacting member and the lever to be closer to each other; and a preloading member interposed between the contacting member and the lever, the preloading member being configured to maintain the contractive spring in a condition stretched to be longer than a natural length; and a cam member configured to be driven by a driving source to move the lever in the vertical direction, wherein the lever is movable by the cam member being driven between:

a first position, in which the lever being moved in a direction to stretch the contractive spring causes the contractive spring having been stretched by the preloading member to be further stretched to urge the contacting member and causes the load applier unit to apply a load that acts in a direction to press the feed roller against the plurality of sheets to the holder; and a second position, in which the contractive spring is maintained in a condition stretched by the preloading member without causing the load applier unit to apply the load that acts in the direction to press the feed roller against the plurality of sheets to the holder.

* * * * *